United States Patent [19]

Swanson

[11] Patent Number: 4,520,348

[45] Date of Patent: May 28, 1985

[54] MULTIPLE REDUNDANT SUPPRESSION DEVICES WITH PROVISION OF SUPERVISION AND FAULT CORRECTION

[75] Inventor: Carl I. Swanson, Boylston, Mass.

[73] Assignee: Kidde, Inc., Saddle Brook, N.J.

[21] Appl. No.: 513,327

[22] Filed: Jul. 13, 1983

[51] Int. Cl.[3] ..... G08B 29/00; A62C 37/18

[52] U.S. Cl. ..... 340/508; 340/506; 340/590; 340/653; 169/23; 169/60

[58] Field of Search ..... 340/508-511, 340/506, 588, 589, 540, 590, 653; 169/23, 60, 61; 361/1, 42

[56] References Cited

U.S. PATENT DOCUMENTS 4,013,128 3/1977 Davis ..... 340/590
4,101,887 7/1978 Osborne ..... 340/540

*Primary Examiner*—Donnie L. Crosland
*Attorney, Agent, or Firm*—John E. Toupal; Harold G. Jarcho

[57] ABSTRACT

An electrical protection system including a plurality of suppressor units each activatable by either a first or a second electrical current responsive activator to suppress abnormal condition. The system further includes a supervisory electrical current source, an activation electrical current source, a first connector circuit connecting all of the first activators in series and a second connector circuit connecting all of the second activators in series. A control circuit connects the supervisory source in parallel with the first and second connector circuits so as to provide in each a predetermined supervisory current that is insufficient to energize the activators. Included in the control circuit is an initiator device for selectively connecting the activation source to the first and second connector circuits so as to provide therethrough an activation current flow greater than the supervisory current flow and sufficient to energize the activators and thereby activate the suppressor units to suppress the abnormal conditions. Also included in the control circuit is a monitor system for monitoring the supervisory current flow through each of the first and second connector circuits.

16 Claims, 1 Drawing Figure

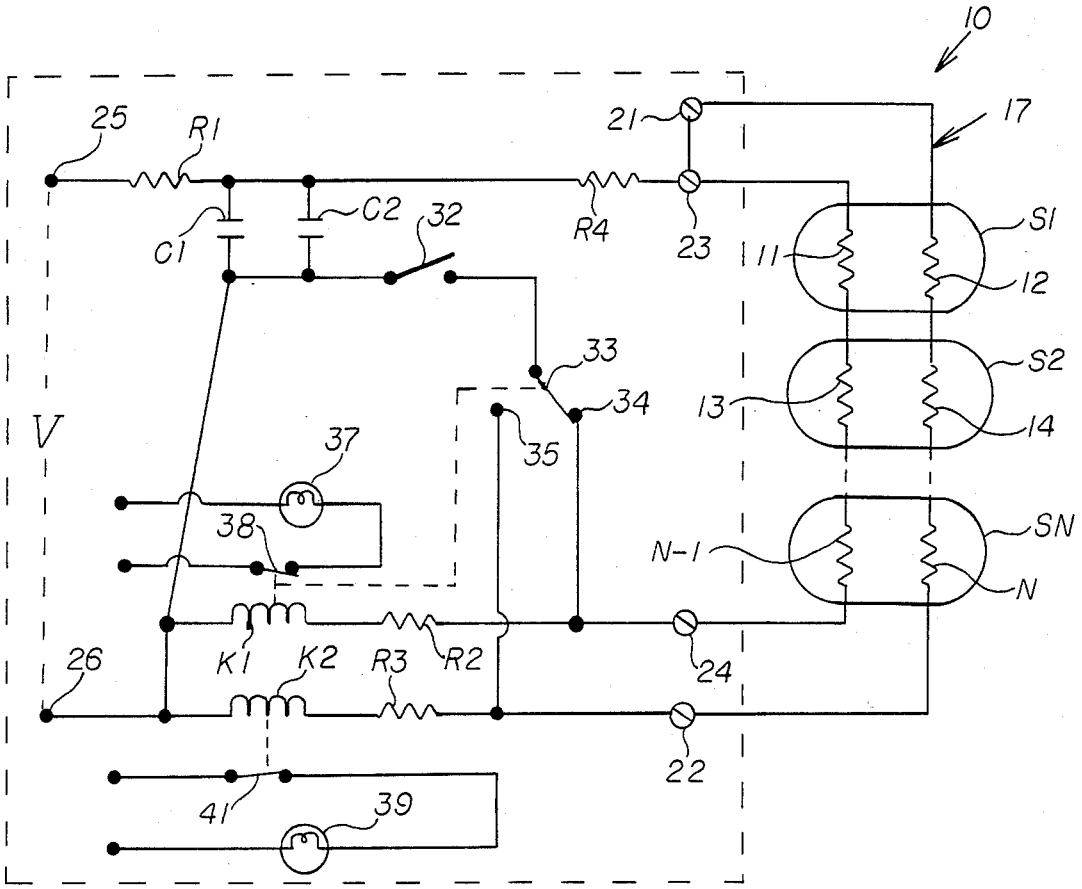
10
17
25
R1
21
C1
C2
32
R4
23
S1
11
12
33
S2
34
13
14
V
37
35
38
SN
N-1
N
K1
K2
R3
R2
24
26
22
41
39

MULTIPLE REDUNDANT SUPPRESSION DEVICES WITH PROVISION OF SUPERVISION AND FAULT CORRECTION

BACKGROUND OF THE INVENTION

This invention relates generally to fire protection systems and, more particularly, to fire protection systems in which a plurality of individual fire suppressor units are simultaneously activated to extinguish a fire.

Certain fire protection systems employ a plurality of strategically located suppressor units, each including an extinguishant filled vessel and an electrically operated release mechanism for inducing discharge of the extinguishant in response to detection of a fire. When simultaneous operation of all suppressor units is desired, the system is provided typically with a control circuit that produces coincident activation of all release mechanisms. In such systems, it is common technique to electrically supervise the electric integrity of the release mechanisms by providing and monitoring a trickle current through a series connection thereof. Although this series supervision establishes a constant knowledge of release mechanism integrity, there remains the possibility that a single release member failure will cause failure of the entire series system. In addition, even a detected failure of a release mechanism can prevent system operation if the detected failure occurs coincidentally with a demand for system actuation.

Partial solutions to this problem are provided in U.S. Pat. Nos. 3,917,001 and 3,952,809. The systems disclosed in those patents include circuits for switching the release mechanisms from a series to a parallel arrangement a short period after system activation is initiated. Although a substantial improvement over the prior art, the disclosed systems do not insure activation of specific system units having dysfunctional individual release mechanisms. In addition, these prior systems can be rendered completely inoperable by certain conditions such as an open circuit in a control line between a control panel and a series of suppressor units.

The object of this invention, therefore, is to provide a more reliable fire protection system of the type employing a plurality of individual suppressant units all having electrically operated release mechanisms adapted for coincident activation.

SUMMARY OF THE INVENTION

The invention is an electrical protection system including a plurality of suppressor units each activatable by either a first or a second electrical current responsive activator to suppress abnormal condition. The system further includes a supervisory electrical current source, an activation electrical current source, a first connector circuit connecting all of the first activators in series and a second connector circuit connecting all of the second activators in series. A control circuit connects the supervisory source in parallel with the first and second connector circuits so as to provide in each a predetermined supervisory current that is insufficient to energize the activators. Included in the control circuit is an initiator device for selectively connecting the activation source to the first and second connector circuits so as to provide therethrough an activation current flow greater than the supervisory current flow and sufficient to energize the activators and thereby activate the suppressor units to suppress the abnormal conditions. Also included in the control circuit is a monitor system for monitoring the supervisory current flow through each of the first and second connector circuits.

According to one feature of the invention, the activation current source comprises an electrical energy storage system for receiving energy from the supervisory source. Preferably the energy storage system consists of a pair of capacitors connected in parallel and each capable of supplying activation current flow to both the first and the second connector circuits. The parallel capacitors provide redundant energy sources, each of which can initiate activation of the suppressor units.

According to another feature of the invention, the control circuit further comprises indicator means responsive to the monitor system and effective to indicate abnormal levels of supervisory current flow. Preferably the system includes a pair of indicators and a pair of monitors for independently indicating abnormal levels of supervisory current flow in either of the first or second connector circuits.

According to yet another feature of the invention, the control circuit comprises a switching mechanism responsive to the supervisory current monitors for alternatively connecting the initiator device between either the first or the second connector circuit and the activation current source. Preferably the switching mechanism normally allows the initiator to connect the activation source only to the first connector circuit and in response to an abnormal supervisory current flow therethrough allows the initiator to connect the activation source to the second connector circuit. In response to a circuit failure in the first connector circuit, system integrity is maintained by the switching mechanism that switches the second connector circuit into an active position.

DESCRIPTION OF THE DRAWINGS

These and other features and objects of the invention will become more apparent upon a perusal of the following description taken in conjunction with the accompanying drawing which is a schematic circuit diagram depicting the invention.

DESCRIPTION OF THE PREFERRED EMBODIMENT

Referring now to the drawing there is schematically illustrated a schematic circuit diagram of a fire protection system 10 according to the invention. The system 10 includes a plurality of suppressor units S1, S2 . . . SN, each retaining a suitable fire extinguishing agent and distributed strategically throughout a fire protected zone. Associated with each of the suppressor units is a pair of explosive activator squibs 11, 12; 13, 14; . . . N−1, N. The suppressors S1–SN and the first and second activators 11–N are conventional and of a type, for example, disclosed in U.S. Pat. Nos. 2,693,240 and 3,523,583. Connecting the first activators 11, 13 . . . N−1 in series is a first connector circuit 16 while a second connector circuit 17 connects in series the second activators 12, 14 . . . N. A central control panel 18 has a pair of terminals 21, 22 that receive opposite ends of the second connector circuit 17 and a pair of terminals 23, 24 that receive opposite ends of the first connector circuit 16.

Located in the control panel 18 are a pair of terminals 25, 26 of a power supply V that provides a source of supervisory current. Also present in the control panel 18 are a pair of energy storage capacitors C1, C2 connected in parallel and receiving energy from the supply V via a resistor R1. A control circuit 31 includes a first relay winding K1 and resistor R2 connected between the supply terminal 26 and the panel terminal 24, a second relay winding K2 and a resistor R3 connected between supply terminal 26 and the panel terminal 22 and a resistor R4 connected between the resistor R1 and the panel terminal 23. Also in the control circuit 31 is a normally open initiator switch 32 that closes in response to the existance of an abnormal condition in the protected zone. Although the initiator switch 32 can be manually operated,it preferably consists of a sensor that automatically closes in response to detection of combustion products. A two position switch 33 is responsive to the relay winding K1 and has contacts 34, 35, respectively, that alternatively connect the initiator switch 32 to either the panel terminal 24 or the panel terminal 22. Finally, the control circuit 31 includes an indicator light 37 connected to voltage source by normally closed contacts 38 associated with the relay K1 and an indicator light 39 connected to a voltage source by normally closed contacts 41 associated with the relay winding K2.

OPERATION

Normally, the supply V provides supervisory current flow through each of the parallel connected first connector circuit 16 and second connector circuit 17 and the relay windings K1, K2. These supervisory currents are controlled by the resistors R2, R3 such that there is sufficient current to activate the relays K1, K2, but much less current than is required to energize the activator squibs 11, 12 . . . N. Thus, the switch 33 is held closed on contact 34 and the contacts 38 and 41 are retained in an open position. Because of the open contacts 38, 41 the indicator lights 37, 37 remain deenergized indicating normal supervisory current flow through the first and second connector circuits 16, 17.

In response to the pressure of combination products in the protected zone, the initiator switch 32 closes causing the capacitors C1, C2 to discharge through the activators 11, 13 . . . N−1 in a circuit that includes the resistor R4 and the closed contact 34. The resultant activation current flow through the first connector circuit 16 induces discharge into the protected zone of the extinguishing agent retained by all of the suppressors S1, S2 . . . SN. Explosion of the squib activators 11, 13 . . . N−1 opens the first connector circuit 16 causing the relay K1 to drop out and transferring the switch 33 from the contact 34 to the contact 35. Since the initiator contact 32 remains closed and the capacitors C1, C2 are sized to remain substantially charged, the closed contact 35 completes a circuit through the resistor R4 that produces activation current flow through the second connector circuit 17. This current flow again is sufficient to explode the activator squibs 12, 14 . . . N. Thus, under normal circuit conditions all of the activators in both the first and second connector circuits 16, 17 are activated providing a high reliability that the extinguishing agent retained by all of the suppressors S1, S2 . . . SN will be released.

In the event of an open in the first connector circuit 16 that includes the activator squibs 11, 13 . . . N−1, supervisory current will cease to flow in that circuit and the relay K1 will drop out. This causes a transfer of the switch 33 to the contact 35 and allows the contacts 38 to close. The resultant energization of the light 37 indicates a circuit abnormality in the first connector circuit 16. However, the closed contact 35 positions the second connector circuit 17 into operative position across the activation current supplying capacitors C1, C2 through the initiator switch 32. Thus, the firing integrity of the system 10 is preserved and in response to closure of the initiator switch 32, activating current flow will be provided through the second connector circuit 17. As described above, such flow will explode the activators 12, 14 . . . N to induce discharge of the extinguishing agent retained by all of the suppressor units S1, S2 . . . SN.

Conversely, if an open circuit occurs in the second connector circuit 17 prior to a closure of the initiator switch 32, the relay winding K2 is deenergized allowing the contact 41 to close. This energizes the light 39 indicating a trouble condition in the second connector circuit 17. The energized winding K1, however, holds the contact 34 closed thereby maintaining the first connector circuit 16 across the supply capacitors C1, C2 through the initiator switch 32. Thus, system integrity is maintained and in response to closure of the initiator switch 32 the activator squib 11, 13 . . . N−1 are exploded to induce release of extinguishing agent retained by all of the suppressors S1, S2 . . . SN.

Obviously, many modifications and variations of the present invention are possible in light of the above teachings. It is to be understood, therefore, that the invention can be practiced otherwise than as specifically described.

What is claimed is:

1. An electrical protection system comprising:

a plurality of suppressor units activatable to suppress an abnormal condition;

first and second electrical current responsive activators associated with each of said suppressor units and each energizable to induce activation thereof;

a first connector circuit connecting all of said first activators in series;

a second connector circuit connecting all of said second activators in series;

a supervisory electrical current source means;

an activation electrical current source means; and control circuit means connected between said supervisory and activation source and said first and second connector circuits, said control circuit means connecting said supervisory source means in parallel with said first and second connector circuits so as to provide a predetermined supervisory current flow therethrough, said supervisory current being insufficient to energize said activators, said control circuit means comprising an initiator means for selectively connecting said activation source means to said first and second connector circuits so as to provide therethrough an activation current flow greater than said supervisory current flow and sufficient to energize said activators to activate said suppressor units, and wherein said control circuit means further comprises monitor means for monitoring said supervisory current flow through said first and second connector circuits.

2. A system according to claim 1 wherein said activation electrical current source means comprises an electrical energy storage means connected to receive energy from said supervisory source means.

3. A system according to claim 2 wherein said energy storage means comprises a pair of capacitors connected in parallel and each capable of supplying said activation current flow.

4. A system according to claim 1 wherein said control circuit further comprises indicator means responsive to said monitor means and adapted to indicate abnormal levels of said supervisory current flow.

5. A system according to claim 4 wherein said monitor means comprises a first monitor means for monitoring the supervisory current flow through said first connector circuit and a second monitor means for monitoring the supervisory current flow through said second connector circuit.

6. A system according to claim 5 wherein said indicator means comprises a first indicator means for indicating an abnormal supervisory current flow through said first connector circuit and a second indicator means for indicating an abnormal supervisory current flow through said second connector circuit.

7. A system according to claim 6 wherein said activation electrical current source means comprises an electrical energy storage means connected to receive energy from said supervisory source means.

8. A system according to claim 7 wherein said energy storage means comprises a pair of capacitors connected in parallel and each capable of supplying said activation current flow.

9. A system according to claim 1 wherein said control circuit means further comprises switching means responsive to said monitor means for together with said initiator means alternatively connecting either said first or said second connector circuit to said activation current source.

10. A system according to claim 9 wherein said monitor means comprises a first monitor means for monitoring the supervisory current flow through said first connector circuit and a second monitor means for monitoring the supervisory current flow through said second connector circuit.

11. A system according to claim 9 wherein said switching means normally allows said initiator means to connect said activation source means only to said first connector circuit and responds to an abnormal supervisory current flow therethrough by allowing said initiator means to connect said activation source means to said second connector circuit.

12. A system according to claim 11 wherein said control circuit further comprises indicator means responsive to said monitor means and adapted to indicate abnormal levels of said supervisory current flow.

13. A system according to claim 12 wherein said activation electrical current source means comprises an electrical energy storage means connected to receive energy from said supervisory source means.

14. A system according to claim 13 wherein said energy storage means comprises a pair of capacitors connected in parallel and each capable of supplying said activation current flow.

15. A system according to claim 1 wherein said initiator comprises a detection means for detecting said abnormal condition.

16. A system according to claim 15 wherein said detection means comprises a fire detection means.

* * * * *